US007788872B2

(12) United States Patent
Platt

(10) Patent No.: US 7,788,872 B2
(45) Date of Patent: Sep. 7, 2010

(54) SEISMIC MAIN BEAM CONNECTION

(75) Inventor: William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 351 days.

(21) Appl. No.: 12/075,058

(22) Filed: Mar. 6, 2008

(65) Prior Publication Data

US 2009/0223146 A1 Sep. 10, 2009

(51) Int. Cl.
*E04C 2/42* (2006.01)

(52) U.S. Cl. ..... 52/665; 52/506.07

(58) Field of Classification Search ..... 52/665, 52/506.07, 712, 506.01, 506.08, 506.09, 52/664, 167, 167.3, 220.6; 403/63, 66, 187
See application file for complete search history.

(56) References Cited

U.S. PATENT DOCUMENTS

| | | | | |
|---|---|---|---|---|
| 2,829,743 | A | 4/1958 | Strauss et al. | |
| 3,142,367 | A | 7/1964 | Brown et al. | |
| 3,189,138 | A | 6/1965 | Znamirowski | |
| 3,284,977 | A | 11/1966 | Lickliter et al. | |
| 3,798,865 | A * | 3/1974 | Curtis | 52/665 |
| 4,335,973 | A * | 6/1982 | Beck et al. | 403/300 |
| 4,580,386 | A * | 4/1986 | Hemphill et al. | 52/664 |
| 5,046,294 | A * | 9/1991 | Platt | 52/506.06 |
| 5,572,844 | A * | 11/1996 | Stackenwalt et al. | 52/506.07 |
| 7,293,393 | B2 * | 11/2007 | Kelly et al. | 52/665 |
| 7,552,567 | B2 * | 6/2009 | Ingratta et al. | 52/506.07 |
| 7,614,195 | B2 * | 11/2009 | Platt et al. | 52/506.06 |
| 7,673,429 | B2 * | 3/2010 | Frecska | 52/506.07 |
| 2007/0022690 | A1 * | 2/2007 | LaLonde | 52/506.07 |
| 2009/0165417 | A1 * | 7/2009 | Jankovec et al. | 52/506.07 |
| 2010/0005747 | A1 * | 1/2010 | Tedesco et al. | 52/506.08 |

* cited by examiner

*Primary Examiner*—Richard E Chilcot, Jr.
*Assistant Examiner*—Anthony N Bartosik
(74) *Attorney, Agent, or Firm*—Eugene Chovanes

(57) ABSTRACT

In a suspended ceiling for earthquake prone locations, a line of seismic main beam connections of the invention between main beams separates the ceiling into segments that move independently of each other during a quake, to limit a build-up in ceiling momentum. A slotted fishplate in the connection is set to keep the beam ends stable about a gap before a quake, and slidably connected about the gap during a quake.

4 Claims, 6 Drawing Sheets

63
86
87
78
72
62
23
71
67
80
81
77
69
70
65
66
73
68
74
25
27
26
86
85
87

SEISMIC MAIN BEAM CONNECTION

BACKGROUND OF THE INVENTION

1. Field of the Invention

Suspended panel ceilings that extend below a structural ceiling are well-known. Such ceilings have a grid of main beams and cross beams that interconnect to form rectangular openings. The grid is suspended from a structural ceiling by hang wires. Panels are supported in the grid openings on flanges of the beams.

The present invention concerns the design of such suspended ceilings in locations prone to earthquakes.

2. Description of the Related Art

A factor in a suspended ceiling design that is subject to seismic events, is ceiling momentum. During a quake, the suspended ceiling is subject to force vectors that cause oscillations along the main beams, and along the cross beams normal to the main beams. Generally, the larger the connected ceiling area and mass of ceiling, the larger the momentum build-up during a quake. Where the mass of ceiling subject to such momentum build-up exceeds certain limits, the ceiling is likely to collapse.

To control the mass of the ceiling area subject to momentum build-up, building codes generally limit the maximum ceiling segment area for a grid with fixed connections in a suspended ceiling subject to earthquakes, to 2,500 sq. ft. Various methods are used to separate a ceiling that exceeds such limit into such 2,500 sq. foot segments or less, that move in a quake independently of one another, as disclosed, for instance, in co-pending U.S. applications Ser. No. 10,592,614 filed Sep. 12, 2006, and Ser. No. 11/895,986, filed Aug. 27, 2007, incorporated herein by reference.

BRIEF SUMMARY OF THE INVENTION

The seismic main beam connection of the present invention is inserted along a line in a direction that extends perpendicularly to a group of parallel main beams, to separate suspended ceiling areas that shake independently of each other during an earthquake.

In a seismic main beam connection of the invention, the beam ends of a pair of connected main beams are, in normal conditions, stabilized about a gap between the ends. In an earthquake, the seismic main beam connection of the invention permits the ends of the connected pair of main beams to oscillate longitudinally, independently of one another about the gap, without forces being transmitted across the gap.

To construct a suspended ceiling in accordance with the invention, the ceiling is first built with fixed main beam connections, in the prior art manner. Then, along a line of fixed main beam connections, extending perpendicularly to the direction of the main beams, each main beam fixed connection is cut out, and a seismic main beam connection of the invention inserted. Each of the seismic main beam connections in the line of inserted seismic main beam connections of the invention, keeps the ends of a connected pair of main beams, under normal conditions, fixed to one another longitudinally about a gap between the ends of a pair of connected beams. The ends of the pair of main beams, however, can move independently toward and away from each other about the gap, longitudinally of the pair of main beams, during a seismic event. Thus, the main beams on one side of the line of seismic main beam connections of the invention can oscillate longitudinally and independently of the beams on the other side of the line of seismic main beam connections of the invention.

When the seismic main beam connection of the invention is inserted in place between the ends of a pair of connected main beams after the original fixed connection is cut out to form the gap, the seismic main beam connection of the invention is set to remain stable until a quake occurs. To set the seismic main beam connection of the invention, a circular rim on one element of such seismic main beam connection is seated in a hole on another element of such seismic main beam connection. When a seismic event occurs that exerts enough force longitudinally of a pair of main beams connected by the seismic main beam connections of the invention, to unseat the rim, the ends of the pair of connected main beams are free to oscillate longitudinally of the main beams, without transmitting any longitudinal forces along such connected main beams.

By permitting the main beams on one side of line of seismic main beam connections of the invention to move independently of the main beams on the other side of the line of seismic main beam connections of the invention, the ceiling can be divided into separate areas, so that during an earthquake, momentum build-up in the mass of the ceiling can be controlled.

DETAILED DESCRIPTION OF THE INVENTION

Figure 1:
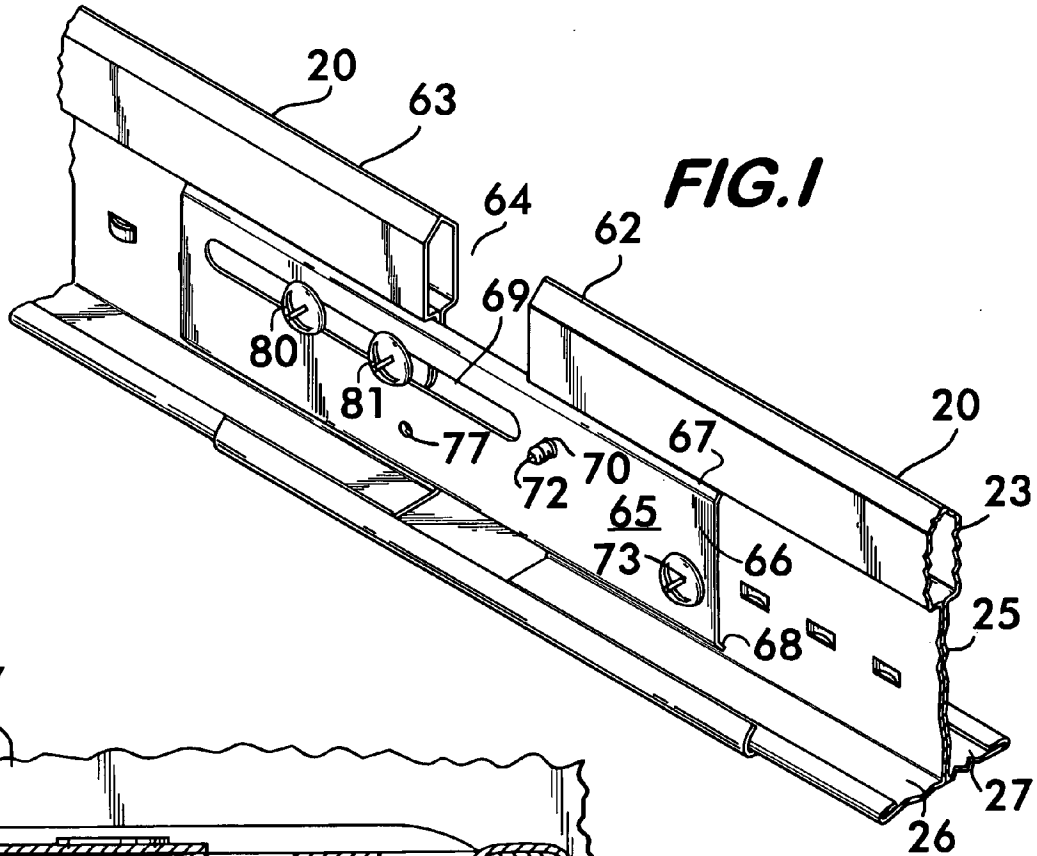
FIG. 1 is a perspective view of the seismic main beam connection of the invention.
Figure 6:
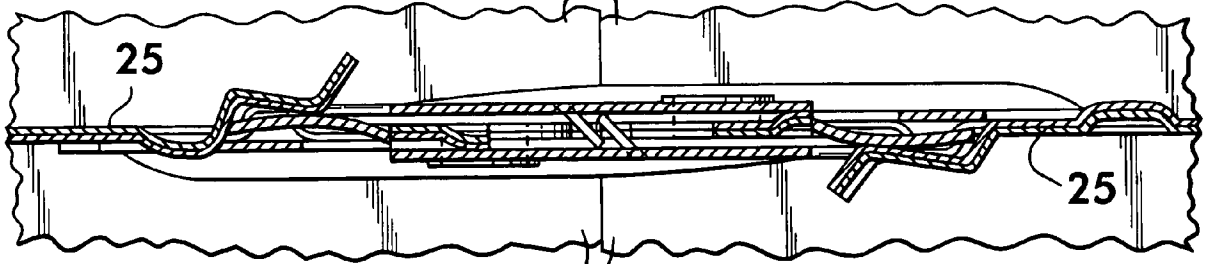
FIG.6 PRIOR ART
FIG. 6 is a sectional plan view of a prior art fixed main beam connection taken on the line 6-6 in FIG. 3.
Figure 2:
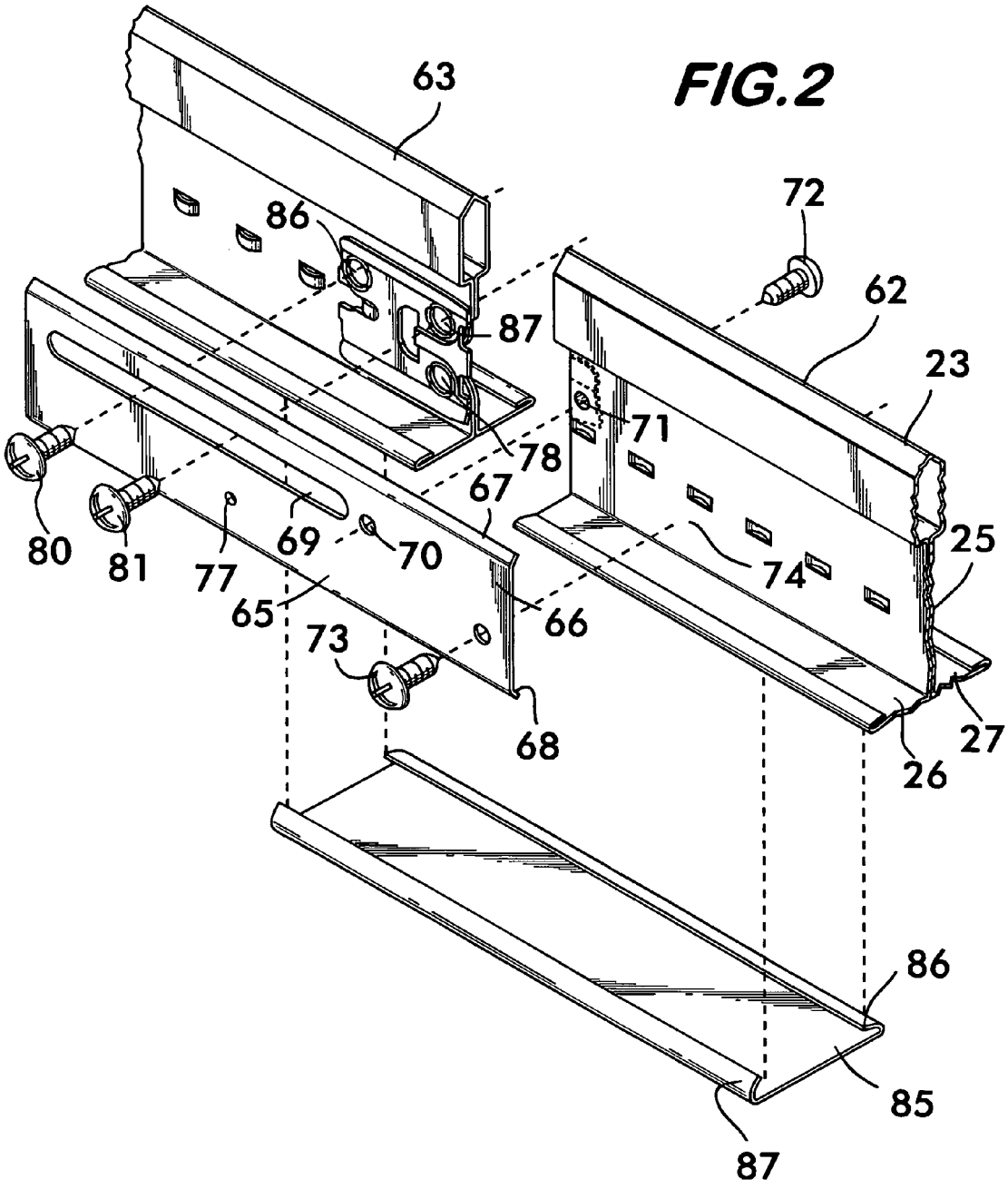
FIG. 2 is an exploded view of the seismic main beam connection of the invention shown in FIG. 1.

Inverted T-beam 20, as used in a grid 21 of a suspended ceiling 24, has, in cross section, a bulb 23, a web 25 depending downward from the bulb 23, and flanges 26 and 27 extending horizontally in opposite directions from the bottom of the web 25.

Such grid 21 has T-beams 20 formed into main beams 28 and cross beams 29.

Figure 3:
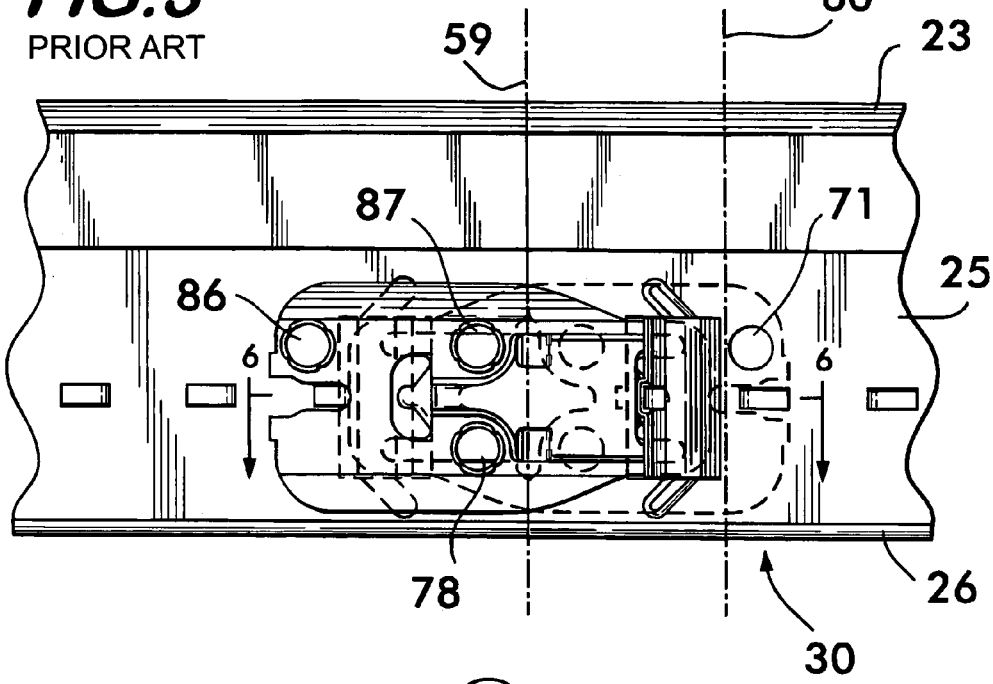
FIG. 3 PRIOR ART
FIG. 3 is an elevational view of a prior art fixed main beam connection before the seismic main beam connection of the invention is inserted.

As seen in FIG. 3, main beams 28, extend in a first direction in the suspended ceiling 24, and cross beams 29 that cross, connected with the main beams 28 at connections 30, to form rectangular grid openings 31, of generally a 2 ft. by 4 ft. dimension. The rectangular grid openings 31 support rectangular panels that rest on the flanges 26 and 27 of the main beams 28 and cross beams 29.

In an earthquake, the ceiling 24, in which grid 21 hangs from a structural ceiling by hang wires, shakes and oscillates, causing a momentum build-up in ceiling 24 that could cause the ceiling 24 to collapse.

In an attempt to control momentum build-up in the ceiling during an earthquake, building codes limit suspended ceilings in earthquake prone locations to ceiling segments that shake independently during a quake, of 2,500 sq. ft., or less, in area. Hence, in ceilings exceeding 2,500 sq. ft. in area, the ceiling is divided into segments of 2,500 sq. ft. or less in area, that shake separately from one another during a quake.

Figure 13:
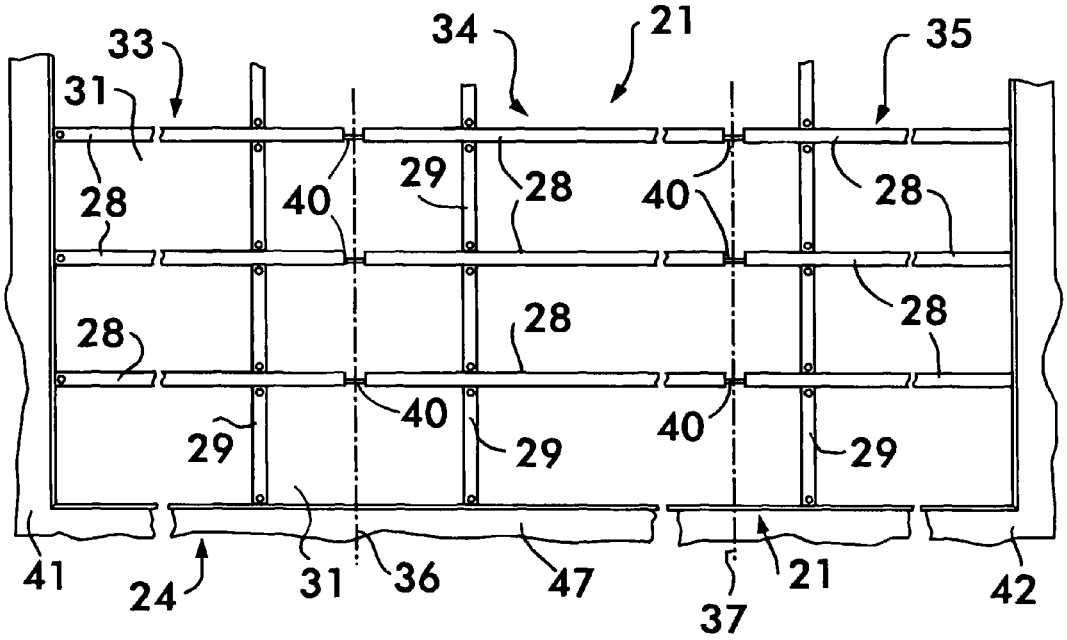
FIG. 13 is a schematic plan view of a ceiling separated into segments, using seismic main beam connections of the invention.

As seen in FIG. 13, a suspended ceiling 24 of, for instance, 7,500 sq. ft., may be divided into three 2,500 sq. ft. segments, 33, 34, and 35, that shake separately from one another during a quake, by inserting the seismic main beam connections of the invention 40 along imaginary lines 36 and 37. Main beams 28 extend in a first direction from, and are fixed to, walls 41 and 42, and cross beams 29 extend in a second direction normal to the direction of the main beams 28, and are fixed to wall 47 and a wall opposing wall 47. The cross beams 29 are connected to the main beams 28 at connections 30.

The main beams 28 are connected longitudinally along imaginary lines 36 and 37 by the seismic main beam connections 40 of the invention. The remaining main beams 28 connections are of the prior art fixed type main beam connections, as shown, for instance, in U.S. Pat. No. 6,523,313 for Main Beam Connection, incorporated herein by reference.

Connections 30 between cross beams 29 and main beams 28 may be of the fixed type, or they may be seismic cross beam connections, as shown, for instance, in co-pending applications '614 and '986 cited above. Such seismic cross beam connections can be selectively inserted at the connections 30 between main beams 28 and cross beams 29, in the event it is desirous to further segment a suspended ceiling 24 across a line of cross beams 29 in the direction between walls 47 and an opposite wall.

In a quake, the ceiling segmented areas 33, 34, and 35 shake independently of each other in the longitudinal direction of the main beams 28, since the seismic main beam connections 40 of the invention does not transmit a force across the lines 36 and 37 of the seismic main beam connections 40 during a quake.

To install the seismic main beam connections 40 of the invention, the ceiling grid 21 for a suspended ceiling is first built with fixed main beam connections 57 of the type shown, for instance, in U.S. Pat. No. 6,523,313, for Main Beam Connection, incorporated herein by reference. With the ceiling grid 21 in place, a seismic main beam connection of the invention 40 is inserted along imaginary lines 36 and 37 as indicated above, at each prior art fixed connection 57 between main beams 28.

Figure 4:
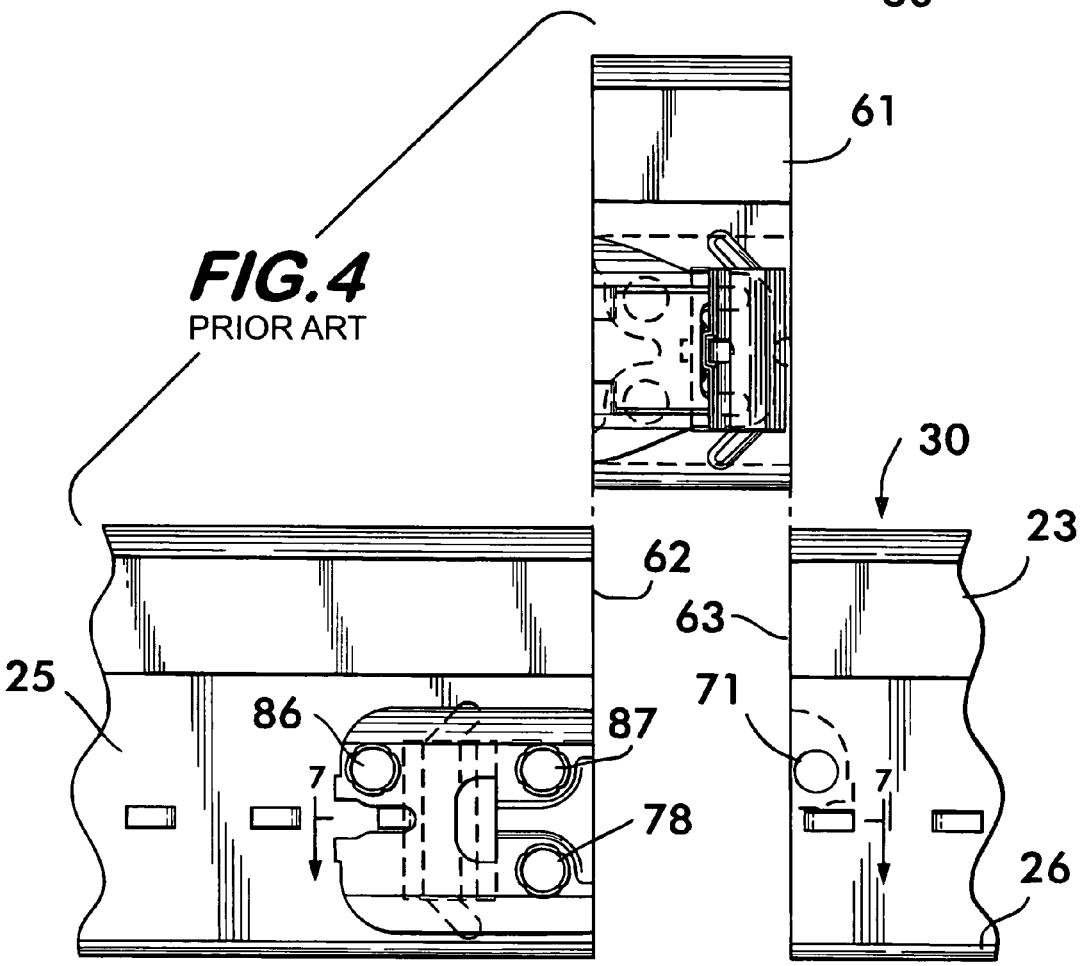
FIG. 4 PRIOR ART
FIG. 4 is an elevational view showing a section of the prior art fixed main beam connection of FIG. 3 removed.
Figure 5:
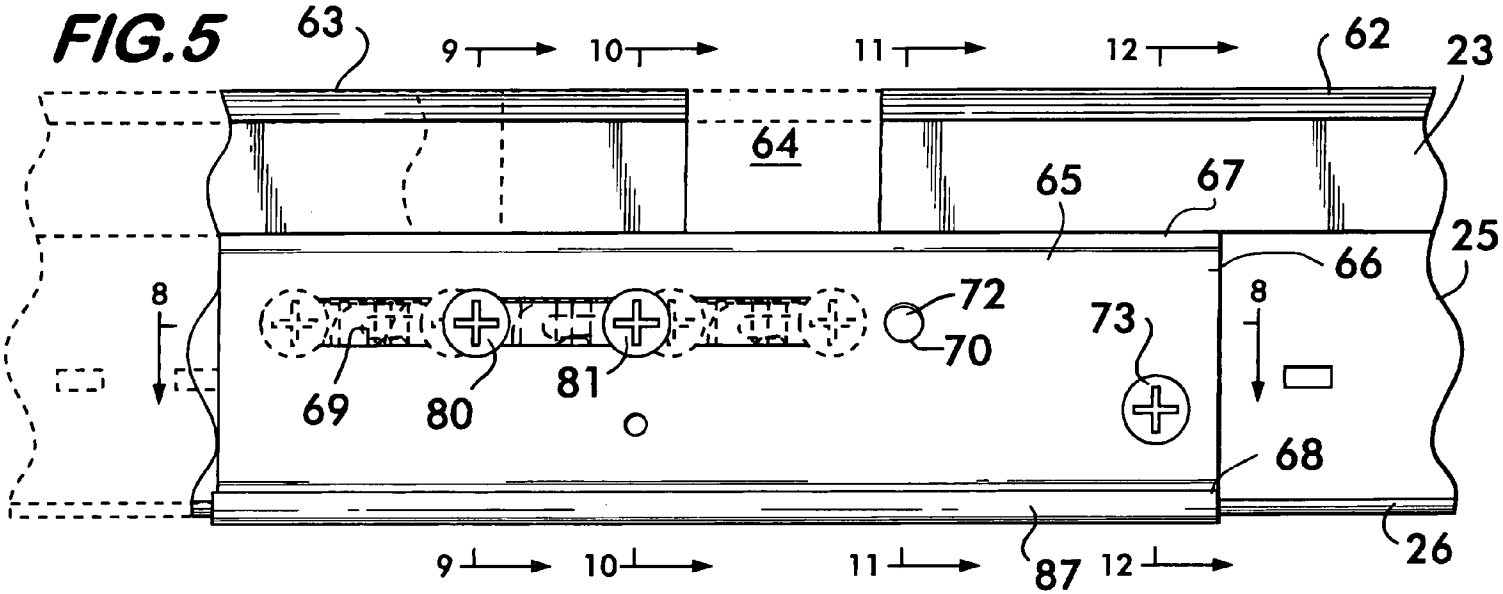
FIG. 5 is an elevational view of the seismic main beam connection of the invention inserted in place of the prior art fixed main beam connection shown in FIG. 3.
Figure 7:
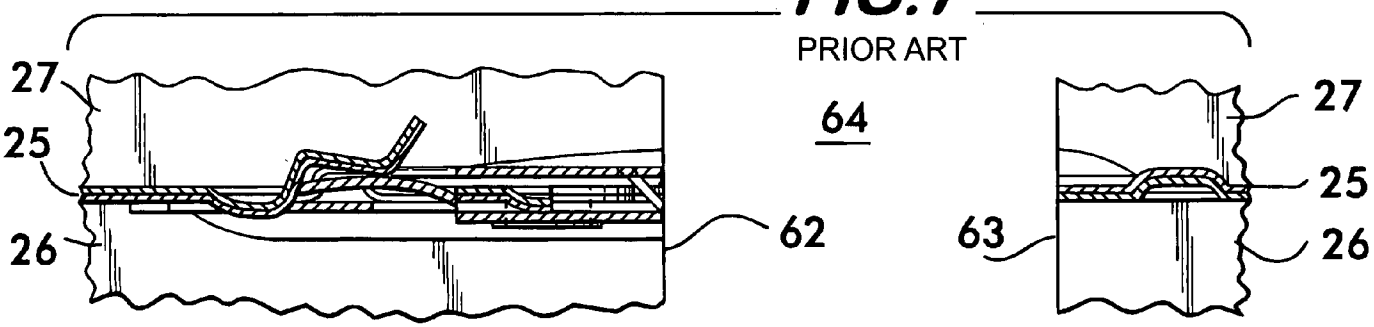
FIG.7 PRIOR ART
FIG. 7 is a sectional view showing the cut out prior art fixed main beam connection, taken on the line 7-7 of FIG. 4.

To so insert the seismic main beam connections 40 of the invention, the prior art fixed main beam connection 57, as shown in the cited '313 patent, and as seen in FIGS. 3 and 4, is cut with shears at 59 and 60 and segment 61 discarded, to form gap 64. The ends of one beam 62, and the other beam 63, of a pair of main beams 28 remain in place, since the grid 21 is in an assembled state, and not subject to movement.

The seismic main beam connection 40 of the invention has a fishplate 65 that straddles the gap 64 and that fits along the pair of webs 25 of main beams 62 and 63 and extends from below the bulbs 23 to above the flange 26. In cross section, the fishplate 65 has a flat face 66 and a slight upper curve 67 and lower curve 68 that ride, during a quake, against the bulbs 23 and webs 25 at the top of the fishplate 65, and against the webs 25 and flanges 26 at the bottom of the fishplate 65, keeping the pair 28 of beams 62 and 63 longitudinally aligned.

The fishplate 65 has a longitudinally extending slot 69.

A hole 70 in the fishplate 65 matches hole 71 in beam 62 which desirably remains in the beam 62 from the original fixed connection, as that shown, for instance, in the cited '313 patent. A self-tapping screw 72 extends through matching holes 70 and 71 to firmly secure the fishplate 65 to the end of one 62 of the pair of main beams 28 in the seismic main beam connection 40. Where no matching hole 71 is available, a self-tapping screw can form a new hole for locating the screw 72 at the desired location.

A second self-tapping screw 73 is also inserted, desirably from the reverse side of web 25, in the general location at 74 to permanently fix the fishplate 65 longitudinally in one 62 of the pair of main beams 28.

The longitudinally extending slot 69 of fishplate 65 is at a height that registers with upper holes 86 and 87 that remain in the end of the one 63 of the pair of main beams 28 that form gap 64. Holes 86 and 87 originally fastened the prior art fixed connector of the cited '313 patent to beam 63, before the cut.

Screws 80 and 81 extend through slot 69 into holes 80 and 81.

Again, as in the connection to one beam 62 of the pair of main beams 28, set forth above, the fishplate 65 fits on the web 25 between the bulb 23 and the flange 26 of the other 63 of the pair of beams 28. However, the other beam 63 of the pair of beams 28 is intended to slide relative to fishplate 65 during a quake, whereas the one 62 of the pair of beams 28 is intended to stay fixed to fishplate 65 during a quake.

Figures 8, 9, 10, 11, 12:
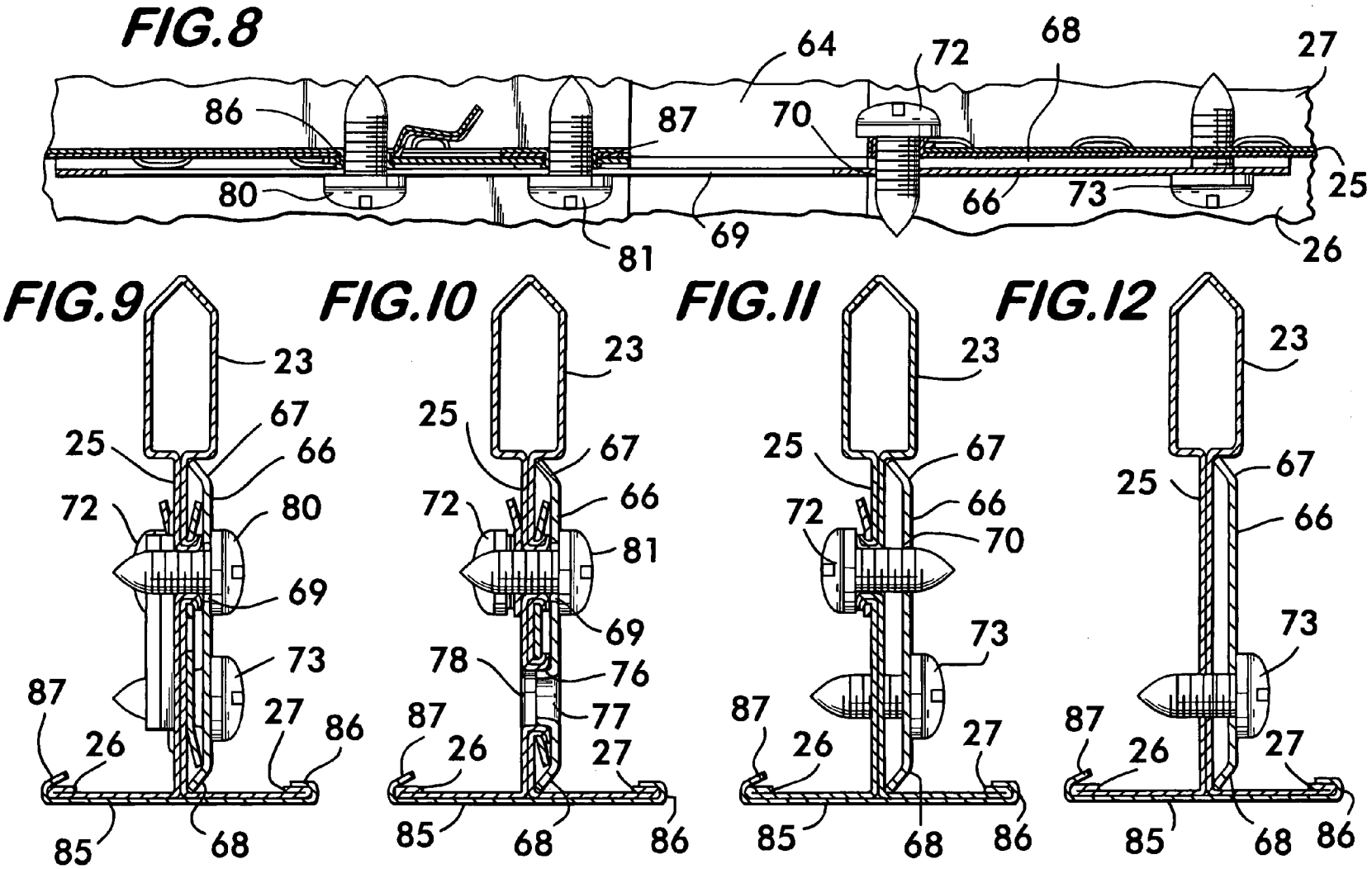
FIG. 8 is a sectional plan view taken on the line 8-8 of FIG. 5.
FIG. 9 is a vertical sectional view taken on the line 9-9 in FIG. 8.
FIG. 10 is a vertical sectional view taken on the line 10-10 in FIG. 8.
FIG. 11 is a vertical sectional view taken on the line 11-11 in FIG. 8.
FIG. 12 is a vertical sectional view taken on the line 12-12 in FIG. 8.

The one 62 and the other 63 of the pair of beams 28 are kept at their original spacing about gap 64, established when the fixed main beam connection is cut to form gap 64, by setting the fishplate 65 so that it cannot slide until an earthquake occurs. A circular rim 76, as best seen in FIG. 10, protrudes from hole 77 in fishplate 65 on the side of flat face 66 adjacent the web 25 of the other 63 of the pair of beams 28. Rim 76 is concentric with, and seats into lower hole 78 remaining from the cut in fixed main beam connection.

When such rim 76 seats in hole 78 the connection 40 of the invention is stable about gap 64.

During a seismic event, rim 76 is forced out of its seat in hole 78 by the shake longitudinally of the connected one 62 and the other 63 of the pair of main beams 28, so that the beams 62 and 63 are free to oscillate longitudinally, independently of one another, about gap 64.

The force necessary during a quake to unseat rim 76 from hole 78, and permit the one 62 and other 63 of the pair of main beams to slide relative to one another about the gap 64, is controlled by the tightness of screws 80 and 81, that are inserted through slot 69.

A cover plate 85 having a smaller upturned edge 86 and a larger upturned edge 87, is fitted over the space in the flanges 26,27 below the gap 64, formed by the cut-out 61, so that from below, the connection of the invention 40 is not visible. The cover plate 85 is free to slide on the flanges 26,27 of the ends of one 63 and the other 62 of the pair of main beams 28, in the seismic main beam connection 40 of the invention, during a quake.

In such manner, a plurality of seismic main beam connections 40 of the invention extending across imaginary lines 36 and 37, as seen in FIG. 13, are inserted, to create isolated segments 33,34 and 35, of the suspended ceiling 24.

Each such isolated segment 33,34,35, of suspended ceiling 24, of 2,500 sq. ft. or less, can move independently, horizontally, longitudinally of the main beams 28 of the other segments, to prevent momentum build-up in the entire ceiling 24.

What is claimed is:

1. In a seismic main beam connection between a pair of aligned main beams in a ceiling grid for a suspended ceiling, a main beam having in cross section a) a bulb, b) a web depending downward from the bulb, and c) a pair of flanges extending in opposite directions from the bottom of the web;

the improvement comprising a gap between the ends of the pair of aligned main beams; and a fishplate extending across the gap a) fixed to the end of one of the pair of main beams, b) having a slot extending longitudinally of the main beams, with c) screws extending through the slot and secured in the other of the pair of main beams; and d) a raised circular rim in the fishplate that seats in a hole in the other of the pair of main beams;

wherein in the seismic main beam connection as constructed, the pair of main beams are stable about the gap, with the rim on the fishplate seated in the hole in the other of the pair of beams; and in an earthquake, the pair of main beams are free to oscillate longitudinally toward and away from each other about the gap when the force of the earthquake unseats the rim in the fishplate from the hole in the other of the pair of main beams.

2. The seismic main beam connection of claim 1, wherein the necessary force to unseat the rim from the hole is set by the tightness of the screws extending through the slot and screwed into the other of the pair of main beams.

3. The seismic main beam connection of claim 1 wherein a cover plate is slidably secured over the bottom of the flanges of the ends of the pair of main beams in the connection.

4. The method of installing the seismic main beam connection of claim 1 in a suspended ceiling having a group of longitudinally connected main beams extending parallel to one another; comprising a) first constructing a suspended ceiling with a fixed connection longitudinally connecting main beams; and b) then cutting out a section of a fixed main beam connection; and then c) inserting the seismic main beam connection defined as the improvement in claim 1, in the cut-out section of the main beam connection.

* * * * *